US005079888A

United States Patent [19]

Hileman et al.

[11] Patent Number: 5,079,888

[45] Date of Patent: Jan. 14, 1992

[54] WALL CLIP AND JOINTER DEVICE

[75] Inventors: John Hileman, Youngstown, Ohio; Budd Brothers, 3711 Mahoning Ave., Youngstown, Ohio 44515

[73] Assignee: Budd R. Brothers, Youngstown, Ohio

[21] Appl. No.: 601,386

[22] Filed: Oct. 23, 1990

[51] Int. Cl.[5] ..... E04G 23/02

[52] U.S. Cl. ..... 52/514; 52/509

[58] Field of Search ..... 292/206, 253; 52/514, 52/509, 512, 768, 506, 208, 235

[56] References Cited

U.S. PATENT DOCUMENTS 3,715,850 2/1973 Chambers ..... 52/235
4,152,877 5/1979 Green .
4,460,420 7/1984 Estrada .
4,464,869 8/1984 Parkin .
4,510,728 4/1985 Key .
4,782,642 11/1988 Conville ..... 52/514

*Primary Examiner*—Michael Safavi
*Attorney, Agent, or Firm*—Harpman & Harpman

[57] ABSTRACT

A two-part expandable wall clip and jointing apparatus to be used in wall board construction to temporarily hold a wall board patch in alignment within an opening in a wall by securing same to the joining perimeter edge of the opening forming a supporting surface for the patch. The wall clip adjusts to varied wall board thicknesses and can be adapted to non-support corner wall configurations.

4 Claims, 1 Drawing Sheet

WALL CLIP AND JOINTER DEVICE

BACKGROUND OF THE INVENTION

1. Technical Field

This invention relates generally to dry wall (sheet rock) construction, repair and joining devices that support and hold adjacent wall board portions to one another for repair and non-supportive abutment.

2. Description of Prior Art

Prior Art devices of this type have relied on a variety of different wall engagement and support configurations to position wall board patches within openings in walls and the like. See for example, U.S. Pat. Nos. 4,464,869, 4,460,420, 4,510,728 and 4,152,877.

In U.S. Pat. No. 4,464,869 a dry wall building panel repair device is disclosed that has a metal base portion with a pair of right angularly positioned upstanding elongated paper tabs with a release covering over a self-adhesive layer.

In U.S. Pat. No. 4,460,420 a repair system for dry wall is disclosed having an apertured metal plate with an overlapping paper member extending therefrom. In use the repaired device is positioned over the opening secured to adjacent edges with the overlapping paper extended beyond for a transitional surface between the patch and the wall.

U.S. Pat. No. 4,510,728 discloses a wall patch adapter having a pair of apertured flat dish configurations of the same diameter with an internal locking keeper to selectively engage and lock same together. The dishes can interlock to one another in an eccentric configuration to bridge the opening to be patched within the plane of the wall itself, thus providing a recessed surface to patch over with joint compound or the like.

U.S. Pat. No. 4,152,877 shows a generally bow tie shaped wire clip that is embedded into the edge opening of the wall adjacent the area to be patched and extends outwardly therefrom to form a support surface for a wall board patch to be held within the opening.

SUMMARY OF THE INVENTION

An expandable wall clip and jointer device for use in supporting wall board patches within a wall opening having a two-part adjustable configuration that is securable to adjacent wall edges and provides spaced wall patch support tabs extending into the opening. A fastener joins the two-part structure that is provided with apertures to be selectively used to affix the expandable wall clip to the wall and patch, recessing the latter for a smooth joint filled surface transition.

DESCRIPTION OF THE PREFERRED EMBODIMENT

Figure 2:
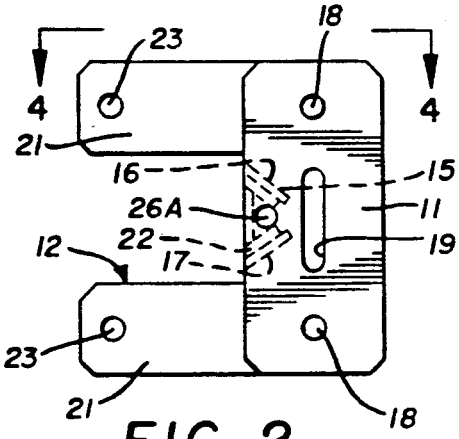
FIG. 2 is a front plan view of the wall clip device.
Figure 3:
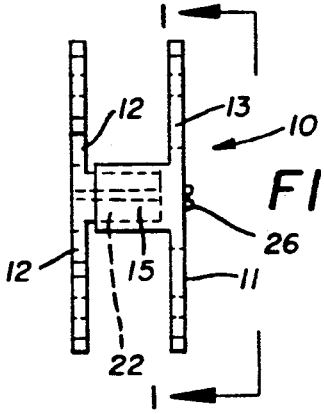
FIG. 3 is an end plan view of the wall clip device.
Figure 4:
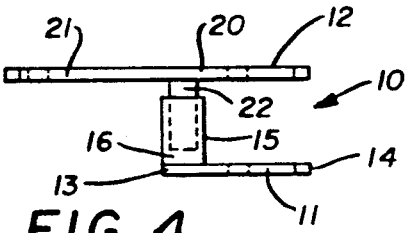
FIG. 4 is a top plan view of the wall clip device.
Figure 1:
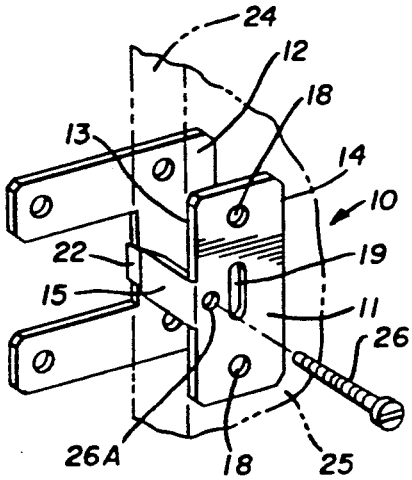
FIG. 1 is a perspective view of the wall clip device positioned on an adjacent wall edge opening.

Referring now to FIG. 1 of the drawings, a two-part wall clip 10 can be seen having a front portion 11 and a back portion 12. The front portion 11 is of a generally flat, rectangular configuration having spaced parallel perimeter edges 13 and 14. A compound right angularly extending sleeve 15 extends from a point midway along its perimeter edge 13, the extension sleeve 15 has a cross-sectional triangular shaped opening defined by its adjacent terminating edge end surfaces 16 and 17, best seen in FIG. 2 of the drawings.

A pair of oppositely disposed apertures at 18 are formed within the front portion 11 with an elongated slot 19 positioned therebetween. The back portion 12 of the wall clip 10 has a generally flat bifurcated body member 20 with parallel vertically aligned apertured tabs 21 extending therefrom. A secondary extension sleeve 22 extends at right angles from said body member 20 between said tabs 21 and is generally of a cross-sectionally triangular configuration, the same as said extension sleeve 15 hereinbefore described. The secondary extension sleeve 22 is of a known transverse dimension less than that of said extension sleeve 15 so as to be registrable within said extension sleeve as will be discussed in greater detail hereinafter.

Apertures are formed in the respective free ends of said tabs 21 at 23.

In use, the front and back portions 11 and 12 respectively are interconnected to another in spaced parallel aligned registration via the engagement of the respective extension sleeves 15 and 22 to form an open channel configuration therebetween for engagement on an existing wall edge 24 of a wall 25 (shown in broken lines in FIG. 1 of the drawings).

Figure 6:
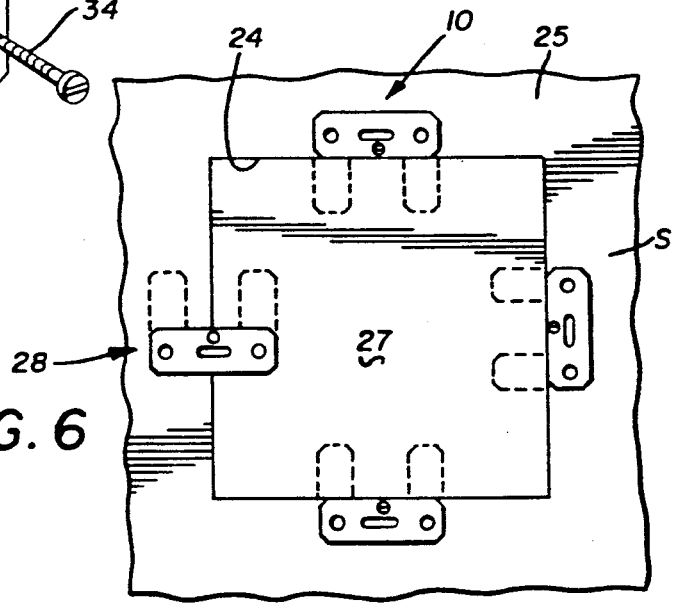
FIG. 6 is a front plan view of a wall portion being patched with a plurality of wall clip devices inserted within.

In this embodiment, the front portion 11 engages an interior facing surface S of said wall 25 with the interconnected back portion 12 engaging the remaining wall surface (not shown) with its respective tabs 21 extending freely therefrom as best seen in FIGS. 1 and 6 of the drawings.

A fastener screw 26 extends through an aperture at 26A in said front portion 11 aligned with said interconnecting sleeves 15 and 22 and wedgeably engages same securing said respective sleeves together at the selected distance required between said front and back portions dependent on the appropriate wall thickness encountered.

When used as a wall patch support, the wall clip 10 thus described will provide (in multiple unit usage, see FIG. 6) a plurality of wall patch supports and tab surfaces onto which a wall patch 27 can be positioned against within an opening within the wall 25. Once positioned as shown, the wall clips 10 are rotated about a pivot point defined by said interconnecting sleeves 15 and 22 in the direction of an arrow shown in FIG. 6 by insertion of a screwdriver (not shown) or the like shaped tool in said elongated slot 12 upon rotation as seen in FIG. 6 generally at 28.

Secondary fastener screws (not shown) are then driven through the apertures at 18 recessing the front portion 11 into the wall 25 and wall patch 27 surfaces for appropriate finishing as is well known in the art.

Figure 5:
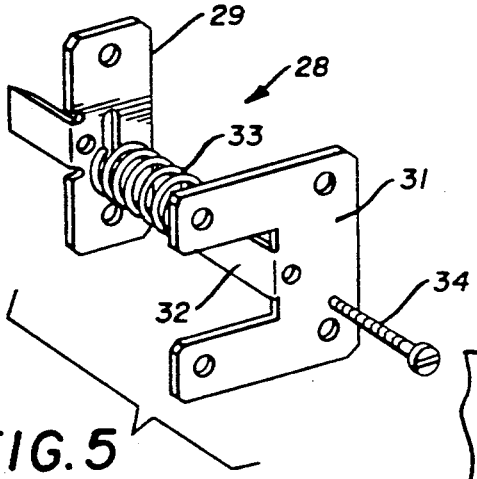
FIG. 5 is a perspective view of an alternate form of the invention.

Referring now to FIG. 5 of the drawings, an alternate form of the invention can be seen wherein the front portion 11 of the wall clip 10 is reversed and uses the secondary back portion 29. A reversed version of the original back portion 12 is shown having an apertured bifurcated flat body member 31 with extension sleeve 32 extending from right angles therefrom. A spring 33 is positioned over the extension sleeve 32 with a secondary fastener screw 34 being positioned for insertion through an aperture in said body member 31 and extension sleeve 32 threadably engaging said secondary back portion 29.

It will be evident from the above description that as the secondary fastener screw 34 is rotated, the spring 33 will be compressed, thus reducing the relative distance between said body members 29 and 31 clamping same to a wall edge (not shown).

It will thus be seen that a new and novel wall board clip has been illustrated and described and that various changes and modifications may be made therein without departing from the spirit of the invention, therefore I claim:

1. A wall board clip and jointer for securing a wall patch within a wall surface comprises a front portion and a back portion, said front portion comprising a generally flat rectangular body member, an extension sleeve extending from one edge of said body member at right angles thereto defining an elongated channel, said back portion comprising a generally bifurcated body member defining spaced parallel planar tabs, a secondary extension sleeve extending at right angles from inbetween said tabs defining an elongated channel, pairs of spaced aligned apertures formed in said respective body members and in said tabs, means for securing said front and back portion to said relevant wall portions and to each other.

2. The wall board clip and jointer of claim 1 wherein said extension sleeve defining an elongated channel, is of a known transverse dimension greater than that of said secondary extension sleeve defining an elongated channel.

3. The wall board clip and jointer of claim 1 wherein said extension sleeve and said secondary extension sleeve are interengageable over one another in longitudinal alignment.

4. The wall board clip and jointer of claim 1 wherein said means for securing said front and back portions to said patch and wall surface and each other comprises fasteners extending through said aligned apertures in said body members and through said extension sleeves.

* * * * *